US011428471B2

(12) United States Patent
Yu et al.

(10) Patent No.: US 11,428,471 B2
(45) Date of Patent: *Aug. 30, 2022

(54) CHAOTIC STIRRING DEVICE AND METHOD COMBINING PLASMA ARC SMELTING AND PERMANENT MAGNET

(71) Applicant: Shanghai University, Shanghai (CN)

(72) Inventors: Jianbo Yu, Shanghai (CN); Zhongming Ren, Shanghai (CN); Xia Li, Shanghai (CN); Zhenqiang Zhang, Shanghai (CN); Jiang Wang, Shanghai (CN); Yujia Zhang, Shanghai (CN)

(73) Assignee: SHANGHAI UNIVERSITY, Shanghai (CN)

( * ) Notice: Subject to any disclaimer, the term of this patent is extended or adjusted under 35 U.S.C. 154(b) by 290 days.

This patent is subject to a terminal disclaimer.

(21) Appl. No.: 16/743,507

(22) Filed: Jan. 15, 2020

(65) Prior Publication Data

US 2020/0263926 A1 Aug. 20, 2020

(30) Foreign Application Priority Data

Feb. 14, 2019 (CN) ..... 201910113540.3

(51) Int. Cl.

| | |
|---|---|
| ***F27D 11/08*** | (2006.01) |
| ***F27B 14/06*** | (2006.01) |
| ***F27B 14/08*** | (2006.01) |
| ***F27D 9/00*** | (2006.01) |
| ***F27B 14/10*** | (2006.01) |
| ***F27B 14/20*** | (2006.01) |

(Continued)

(52) U.S. Cl.

CPC ..... *F27D 11/08* (2013.01); *F27B 14/06* (2013.01); *F27B 14/10* (2013.01); *F27B 14/20* (2013.01); *F27D 27/00* (2013.01); *F27B 2014/0837* (2013.01); *F27D 2009/0013* (2013.01); *F27D 2099/0021* (2013.01); *F27M 2003/13* (2013.01)

(58) Field of Classification Search

None

See application file for complete search history.

(56) References Cited

U.S. PATENT DOCUMENTS 3,655,903 A * 4/1972 Roman ..... H01J 37/3053 373/13

6,391,081 B1 * 5/2002 Uchikoshi ..... C22B 4/005 75/10.19

(Continued)

*Primary Examiner* — Scott R Kastler

(74) *Attorney, Agent, or Firm* — Pearne & Gordon LLP

(57) ABSTRACT

A chaotic stirring device combining plasma arc smelting and permanent magnet including a furnace body; the furnace body is provided therein with a water-cooled copper crucible; the center of an upper surface of the water-cooled copper crucible is a groove for placing raw metals, and the water-cooled copper crucible is internally a hollow cavity; a return pipe is disposed directly below the groove in the hollow cavity; an upper end of the return pipe is vertical upward, and is horizontally provided with a filter screen; a spherical magnet is placed between the filter screen and the groove; one side of the water-cooled copper crucible is provided with a first water inlet pipe and a first water outlet pipe; the first water inlet pipe is connected to the hollow cavity, and the first water outlet pipe is connected to the bottom of the return pipe.

12 Claims, 1 Drawing Sheet

(51) Int. Cl.
*F27D 27/00* (2010.01)
*F27D 99/00* (2010.01)

(56) References Cited

U.S. PATENT DOCUMENTS 11,057,966 B2 * 7/2021 Ren ..... C22B 9/20
2020/0263926 A1 * 8/2020 Yu ..... F27B 14/20

* cited by examiner

CHAOTIC STIRRING DEVICE AND METHOD COMBINING PLASMA ARC SMELTING AND PERMANENT MAGNET

TECHNICAL FIELD

The present invention relates to the field of plasma arc smelting, and in particular, to a chaotic stirring device and method combining plasma arc smelting and permanent magnet.

BACKGROUND

Plasma arc smelting is employed to melt and refine a metal by utilizing a concentrated and controllably stabilized plasma arc generated between an electrode and a raw material as a heat source. The plasma arc is a high-speed plasma with the characteristic of energy concentration. In smelting, a tungsten electrode is generally used as a cathode, and a smelted metal is used as an anode. The temperature at which the plasma arc contacts the surface of a molten metal bath is usually 5,000 to 30,000 K, and an impurity is removed as slag or gas. Plasma arc smelting can have a furnace atmosphere that is widely selected, and the furnace atmosphere can be changed according to different needs to achieve special metal or alloy smelting.

A plasma arc smelting process mostly uses a water-cooled copper crucible. A metal at the bottom of the crucible is in direct contact with the water-cooled copper crucible, causing rapid heat loss and failure to reach a melting temperature; as a result, the bottom metal part in the crucible remains solid, while an upper metal part is in a molten state, and a middle metal part is in a slow flow state. If the metal at the bottom of the crucible needs to be smelted, it is necessary to turn the metal and restart a circuit, which increases the melting time and cost.

SUMMARY

An objective of the present invention is to provide a chaotic stirring device and method combining plasma arc smelting and permanent magnet, which disposes a spherical magnet inside a water-cooled copper crucible, and utilizes the instability of a cooling water flow to constantly change the position of the spherical magnet, so that a metal in a groove is rotated, and a solid part at the bottom is continuously turned and re-smelted, thereby shortening a smelting step, saving smelting time, and increasing smelting efficiency.

To achieve the above purpose, the present invention provides the following technical solutions.

The present invention provides a chaotic stirring device combining plasma arc smelting and permanent magnet, where the device includes a furnace body; the furnace body is provided therein with a water-cooled copper crucible; the center of an upper surface of the water-cooled copper crucible is a groove for placing raw metals;

the water-cooled copper crucible is internally a hollow cavity; a return pipe is disposed at a place directly below the groove in the hollow cavity; an upper end of the return pipe is vertical upward, and is horizontally provided with a filter screen; a spherical magnet is placed between the filter screen and the groove; one side of the water-cooled copper crucible is provided with a first water inlet pipe and a first water outlet pipe;

the first water inlet pipe is connected to the hollow cavity, and the first water outlet pipe is connected to the bottom of the return pipe, to form a water flow passage in the water-cooled copper crucible.

Optionally, a tungsten electrode and a nozzle are disposed directly above the groove, and the tungsten electrode is located inside the nozzle.

Optionally, the nozzle is a hollow cylindrical structure open below; an inner side of a side wall of the nozzle is provided with an annular cavity along a circumferential direction; the annular cavity communicates with a second water inlet pipe and a second water outlet pipe.

Optionally, the first water inlet pipe and the second water inlet pipe are connected to the same water inlet valve, and the first water outlet pipe and the second water outlet pipe are connected to the same water outlet valve.

Optionally, the return pipe is a cylindrical pipe.

Optionally, a vertical distance between an edge of the upper end of the return pipe and the groove is smaller than a diameter of the spherical magnet, so that the spherical magnet is restricted in a space formed by the filter screen and the groove.

The present invention further provides a chaotic stirring method combining plasma arc smelting and permanent magnet, where the stirring method includes:

placing raw metals in a groove of a water-cooled copper crucible;

starting a tungsten electrode, and conducting plasma arc smelting of the raw metal in the water-cooled copper crucible; and opening a water inlet valve and a water outlet valve, to continuously inject cooling water into the water-cooled copper crucible and a nozzle, and continuously discharge water in the water-cooled copper crucible and the nozzle.

Optionally, the opening a water inlet valve and a water outlet valve, to continuously inject cooling water into the water-cooled copper crucible and a nozzle, and continuously discharge water in the water-cooled copper crucible and the nozzle specifically includes: opening the water inlet valve and the water outlet valve, setting a flow rate of the water inlet valve to be greater than a flow rate of the water outlet valve, so that the injected cooling water fills the water-cooled copper crucible and the nozzle, and a dynamic balance of the injected cooling water and the discharged cooling water is finally reached.

According to the specific embodiments provided in the present invention, the present invention discloses the following technical effects.

A water-cooled copper crucible inside a furnace body is provided thereon with a groove for smelting a metal; a return pipe is disposed inside the water-cooled copper crucible directly below the groove; an end of the return pipe is provided with a filter screen; a spherical magnet is placed on the filter screen; cooling water is continuously injected into the water-cooled copper crucible, and is continuously discharged; the instability of a cooling water flow is used to constantly change the position of the spherical magnet; under the action of a magnetic force, the metal inside the groove is turned, so that a solid metal part at the bottom of the groove is continuously turned and re-smelted, thereby achieving continuous smelting, shortening a smelting step, saving smelting time, and increasing smelting efficiency.

At the same time, the cooling water is continuously injected into and discharged out of a nozzle that wraps a tungsten electrode, thereby protecting the nozzle from being damaged due to excessive temperature during the plasma arc smelting process.

BRIEF DESCRIPTION OF THE DRAWINGS

To describe the technical solutions in the embodiments of the present invention or in the prior art more clearly, the following briefly introduces the accompanying drawings required for describing the embodiments. Apparently, the accompanying drawings in the following description show merely some embodiments of the present invention, and a person of ordinary skill in the art may still derive other accompanying drawings from these accompanying drawings without creative efforts.

DESCRIPTION OF REFERENCE NUMERALS

1. furnace body, 2. water inlet valve, 3. tungsten electrode, 4. raw metal, 5. spherical magnet, 6. filter screen, 7. return pipe, 8. water-cooled copper crucible, 9. first water inlet pipe, 10. first water outlet pipe, 11. second water inlet pipe, 12. second water outlet pipe, 13. water outlet valve, 14. nozzle, and 15. annular cavity.

DETAILED DESCRIPTION

The following clearly and completely describes the technical solutions in the embodiments of the present invention with reference to accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

An objective of the present invention is to provide a chaotic stirring device and method combining plasma arc smelting and permanent magnet, which utilizes the instability of a cooling water flow to constantly change the position of a spherical magnet, causing a metal in a molten metal bath to continuously rotate with a position changing accordingly, so that a solid part at the bottom of the molten bath is continuously turned and redrawn into the molten bath, thereby achieving continuous smelting, shortening a smelting step, saving smelting time, and increasing smelting efficiency.

In order to make the above objectives, features, and advantages of the present invention more apparent and more comprehensible, the present invention is further described in detail with reference to the accompanying drawings and specific implementations.

Figure 1:
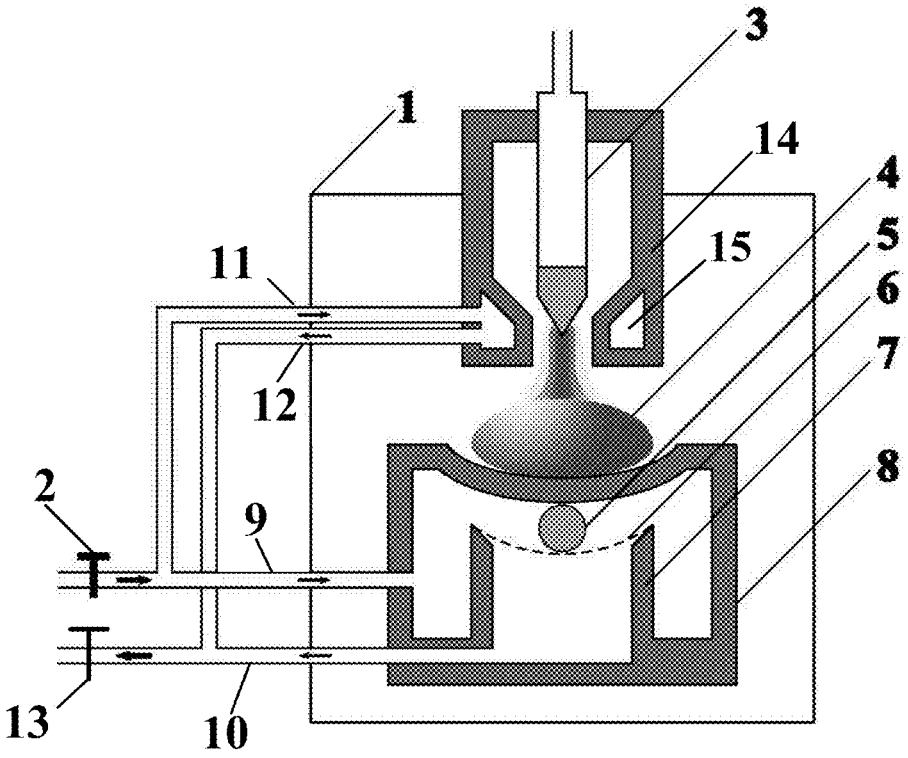
FIG. 1 is a schematic structural diagram of a chaotic stirring device combining plasma arc smelting and permanent magnet according to the present invention.

FIG. 1 is a schematic structural diagram of a chaotic stirring device combining plasma arc smelting and permanent magnet according to the present invention. As shown in FIG. 1, the device includes a furnace body 1; the furnace body 1 is provided therein with a water-cooled copper crucible 8; the center of an upper surface of the water-cooled copper crucible 8 is a groove for placing raw metals 4.

Figure 2:
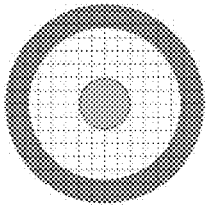
FIG. 2 is a top view of a return pipe, a filter screen and a spherical magnet of a chaotic stirring device combining plasma arc smelting and permanent magnet according to the present invention.
Figure 3:
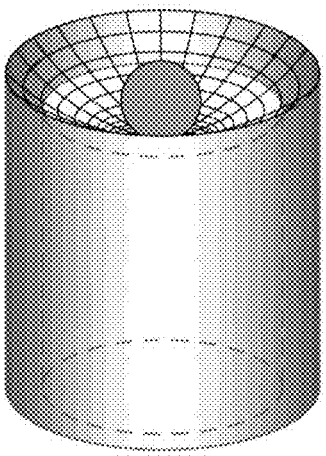
FIG. 3 is a three-dimensional structural diagram of a return pipe, a filter screen and a spherical magnet of a chaotic stirring device combining plasma arc smelting and permanent magnet according to the present invention.

The water-cooled copper crucible 4 is internally a hollow cavity; a return pipe is disposed at a place directly below the groove in the hollow cavity 7; as shown in FIG. 2 and FIG. 3, an upper end of the return pipe 7 is vertical upward, and is horizontally provided with a filter screen 6; a spherical magnet 5 is placed between the filter screen 6 and the groove; one side of the water-cooled copper crucible 8 is provided with a first water inlet pipe 9 and a first water outlet pipe 10.

The first water inlet pipe 9 is connected to the hollow cavity, and the first water outlet pipe 10 is connected to the bottom of the return pipe 7 to, form a water flow passage in the water-cooled copper crucible 8.

A tungsten electrode 3 and a nozzle 14 are disposed directly above the groove, and the tungsten electrode 3 is located inside the nozzle 14.

The nozzle 14 is a hollow cylindrical structure open below; an inner side of a side wall of the nozzle 14 is provided with an annular cavity 15 along a circumferential direction; the annular cavity 15 communicates with a second water inlet pipe 11 and a second water outlet pipe 12.

The first water inlet pipe 9 and the second water inlet pipe 11 are connected to the same water inlet valve 2, and the first water outlet pipe 10 and the second water outlet pipe 12 are connected to the same water outlet valve 13.

The return pipe 7 is a cylindrical pipe.

A vertical distance between an edge of the upper end of the return pipe 7 and the groove is smaller than a diameter of the spherical magnet 5, so that the spherical magnet 5 is restricted in a space formed by the filter screen 6 and the groove.

The size and type of the spherical magnet 5 can be adjusted according to the size of the device.

The present invention further provides a chaotic stirring method combining plasma arc smelting and permanent magnet, including the following steps:

Step 1: equipment assembly, that is, assemble a furnace body 1, a tungsten electrode 3, a water-cooled copper crucible 8, a spherical magnet 5 and a filter screen 6 as required, and debug.

Step 2: after the equipment is debugged, place raw metals 4 in a groove of the water-cooled copper crucible 8, and open cooling water.

Step 3: start the tungsten electrode 3, and conduct plasma arc smelting of the raw metal 4 in the water-cooled copper crucible 8.

Step 4: the spherical magnet 5 inside the water-cooled copper crucible 8 is affected by the flow of the cooling water and moves in an uncertain lateral or vertical direction in a restricted space, where a magnetic field generated by a plasma arc generates a magnetic force to the spherical magnet 5 in the water-cooled copper crucible 8, so that the spherical magnet 5 is in a stable position state in which N and S poles are vertically up and down. At the same time, the spherical magnet 5 generates an electromagnetic force to a molten metal in the groove of the water-cooled copper crucible 8 to push the molten metal to continuously rotate clockwise or counterclockwise in a horizontal direction. When the molten metal rotates in the horizontal direction, an internal molten metal rotates vertically, with a position changing continuously in the groove, so that a solid part at the bottom of a molten bath in contact with the water-cooled copper crucible 8 is continuously turned and smelted into the molten bath, to complete the smelting.

The present invention utilizes the electromagnetic force generated to the spherical magnet 5 in the water-cooled copper crucible 8 by the magnetic field generated by the plasma arc to enable the spherical magnet 5 to be in a stable position state in which the N and S stages are vertically up and down, so that an electromagnetic force generated by an own magnetic field of the spherical magnet 5 acts on the molten metal of the raw metal 4 in the groove of the water-cooled copper crucible 8 to push the molten metal to flow clockwise or counterclockwise horizontally, thereby promoting the homogenization of an alloy composition and the diffusion of an impurity element, and achieving the purpose of improving the effect of plasma arc smelting and increasing the efficiency of plasma arc smelting. Moreover, the spherical magnet 5 inside the water-cooled copper crucible 8 is affected by the instability of the cooling water flow to move in an uncertain lateral or vertical direction or position in the restricted space, causing the molten metal to be affected by the electromagnetic force to follow the spherical magnet 5 to move in an uncertain lateral or vertical direction or position in the groove of the water-cooled crucible 8; thus, a solid molten metal at the bottom in contact with the water-cooled copper crucible 8 is continuously turned and re-smelted into the molten bath, thereby eliminating a step for turning a sample for secondary smelting, saving smelting time, and increasing smelting efficiency.

In this paper, several examples are used for illustration of the principles and implementations of the present invention. The description of the foregoing embodiments is used to help illustrate the method of the present invention and the core principles thereof. In addition, those of ordinary skill in the art can make various modifications in terms of specific implementations and scope of application in accordance with the teachings of the present invention. In conclusion, the content of the present specification shall not be construed as a limitation to the present invention.

What is claimed is:

1. A chaotic stirring device comprising a furnace body, wherein the furnace body comprises a water-cooled copper crucible; the center of an upper surface of the water-cooled copper crucible comprises a groove for placing raw metals; the water-cooled copper crucible comprises an internal hollow cavity, wherein a return pipe is disposed directly below the groove in the hollow cavity; an upper end of the return pipe is vertically upward, and is horizontally provided with a filter screen; a spherical magnet is placed between the filter screen and the groove; one side of the water-cooled copper crucible is provided with a first water inlet pipe and a first water outlet pipe, wherein the first water inlet pipe is connected to the hollow cavity, and the first water outlet pipe is connected to the bottom of the return pipe, to form a water flow passage in the water-cooled copper crucible; wherein a tungsten electrode and a nozzle are disposed directly above the groove, and the tungsten electrode is located inside the nozzle so as to conduct plasma arc smelting.

2. A chaotic stirring method combining plasma arc smelting and permanent magnet, applied to a chaotic stirring device comprising a furnace body, wherein the furnace body comprises a water-cooled copper crucible; the center of an upper surface of the water-cooled copper crucible comprises a groove for placing raw metals; the water-cooled copper crucible comprises an internal hollow cavity, wherein a return pipe is disposed directly below the groove in the hollow cavity; an upper end of the return pipe is vertically upward, and is horizontally provided with a filter screen; a spherical magnet is placed between the filter screen and the groove; one side of the water-cooled copper crucible is provided with a first water inlet pipe and a first water outlet pipe, wherein the first water inlet pipe is connected to the hollow cavity, and the first water outlet pipe is connected to the bottom of the return pipe, to form a water flow passage in the water-cooled copper crucible; wherein the stirring method comprises:

placing raw metals in the groove of the water-cooled copper crucible;

starting a tungsten electrode, and conducting plasma arc smelting of the raw metal in the water-cooled copper crucible; and opening a water inlet valve and a water outlet valve, to continuously inject cooling water into the water-cooled copper crucible and a nozzle, and continuously discharge water in the water-cooled copper crucible and the nozzle.

3. The chaotic stirring method combining plasma arc smelting and permanent magnet according to claim 2, wherein the opening a water inlet valve and a water outlet valve, to continuously inject cooling water into the water-cooled copper crucible and a nozzle, and continuously discharge water in the water-cooled copper crucible and the nozzle specifically comprises: opening the water inlet valve and the water outlet valve, setting a flow rate of the water inlet valve to be greater than a flow rate of the water outlet valve, so that the injected cooling water fills the water-cooled copper crucible and the nozzle, and a dynamic balance of the injected cooling water and the discharged cooling water is finally reached.

4. A chaotic stirring method combining plasma arc smelting and permanent magnet, applied to the chaotic stirring device according to claim 2, wherein the tungsten electrode and the nozzle are disposed directly above the groove, and the tungsten electrode is located inside the nozzle so as to conduct plasma arc smelting.

5. A chaotic stirring method combining plasma arc smelting and permanent magnet according to claim 2, wherein the nozzle is a hollow cylindrical structure open below; an inner side of a side wall of the nozzle is provided with an annular cavity along a circumferential direction; the annular cavity communicates with a second water inlet pipe and a second water outlet pipe.

6. A chaotic stirring method combining plasma arc smelting and permanent magnet according to claim 2, wherein the first water inlet pipe and the second water inlet pipe are connected to a same water inlet valve, and the first water outlet pipe and the second water outlet pipe are connected to a same water outlet valve.

7. A chaotic stirring method combining plasma arc smelting and permanent magnet according to claim 2, wherein the return pipe is a cylindrical pipe.

8. A chaotic stirring method combining plasma arc smelting and permanent magnet according to claim 2, wherein a vertical distance between an edge of the upper end of the return pipe and the groove is smaller than a diameter of the spherical magnet, so that the spherical magnet is restricted in a space formed by the filter screen and the groove.

9. The chaotic stirring method combining plasma arc smelting and permanent magnet according to claim 4, wherein the opening the water inlet valve and the water outlet valve, to continuously inject cooling water into the water-cooled copper crucible and the nozzle, and continuously discharge water in the water-cooled copper crucible and the nozzle specifically comprises: opening the water inlet valve and the water outlet valve, setting a flow rate of the water inlet valve to be greater than a flow rate of the water outlet valve, so that the injected cooling water fills the water-cooled copper crucible and the nozzle, and a dynamic balance of the injected cooling water and the discharged cooling water is reached.

10. The chaotic stirring method combining plasma arc smelting and permanent magnet according to claim 5, wherein the opening the water inlet valve and the water outlet valve, to continuously inject cooling water into the water-cooled copper crucible and the nozzle, and continuously discharge water in the water-cooled copper crucible and the nozzle specifically comprises: opening the water inlet valve and the water outlet valve, setting a flow rate of the water inlet valve to be greater than a flow rate of the water outlet valve, so that the injected cooling water fills the water-cooled copper crucible and the nozzle, and a dynamic balance of the injected cooling water and the discharged cooling water is reached.

11. The chaotic stirring method combining plasma arc smelting and permanent magnet according to claim 6, wherein the opening the water inlet valve and the water outlet valve, to continuously inject cooling water into the water-cooled copper crucible and the nozzle, and continuously discharge water in the water-cooled copper crucible and the nozzle specifically comprises: opening the water inlet valve and the water outlet valve, setting a flow rate of the water inlet valve to be greater than a flow rate of the water outlet valve, so that the injected cooling water fills the water-cooled copper crucible and the nozzle, and a dynamic balance of the injected cooling water and the discharged cooling water is reached.

12. The chaotic stirring method combining plasma arc smelting and permanent magnet according to claim 7, wherein the opening the water inlet valve and the water outlet valve, to continuously inject cooling water into the water-cooled copper crucible and the nozzle, and continuously discharge water in the water-cooled copper crucible and the nozzle specifically comprises: opening the water inlet valve and the water outlet valve, setting a flow rate of the water inlet valve to be greater than a flow rate of the water outlet valve, so that the injected cooling water fills the water-cooled copper crucible and the nozzle, and a dynamic balance of the injected cooling water and the discharged cooling water is reached.

* * * * *